US006003170A

United States Patent [19]

Humpert et al.

[11] Patent Number: 6,003,170

[45] Date of Patent: Dec. 21, 1999

[54] SINGLE-LEVER FAUCET WITH ELECTRONIC CONTROL

[75] Inventors: Jürgen Humpert, Hemer; Eckhard Gransow, Fröndenberg, both of Germany

[73] Assignee: Friedrich Grohe AG, Hemer, Germany

[21] Appl. No.: 09/087,267

[22] Filed: May 29, 1998

[30] Foreign Application Priority Data

Jun. 4, 1997 [DE] Germany ..... 197 23 312

[51] Int. Cl.[6] ..... E03C 1/05

[52] U.S. Cl. ..... 4/623; 4/668; 4/676; 251/129.03; 251/129.04

[58] Field of Search ..... 4/623, 668, 675–678; 251/129.03, 129.04

[56] References Cited

U.S. PATENT DOCUMENTS

| | | | |
|---|---|---|---|
| 3,487,477 | 1/1970 | Classen | 4/668 |
| 4,604,764 | 8/1986 | Enzo . | |
| 4,688,277 | 8/1987 | Kakinoki et al. | 4/623 |
| 4,762,273 | 8/1988 | Gregory et al. | 4/623 |
| 5,170,944 | 12/1992 | Shirai | 251/129.04 |
| 5,287,570 | 2/1994 | Peterson . | |
| 5,744,033 | 4/1998 | Bertrand et al. | 4/675 |

FOREIGN PATENT DOCUMENTS

| | | | |
|---|---|---|---|
| 3606385 | 10/1986 | Germany . | |
| 38 07 844 | 9/1989 | Germany . | |
| 4-124328 | 4/1992 | Japan | 4/623 |
| 2248469 | 4/1992 | United Kingdom . | |

*Primary Examiner*—Charles R. Eloshway
*Attorney, Agent, or Firm*—Herbert Dubno; Andrew M. Wilford

[57] ABSTRACT

A faucet assembly has a conduit defining a flow path between a supply of water and an outlet, a mechanical valve in the conduit and having an open position and a closed position, and a lever coupled to the mechanical valve for shifting it between its open and closed positions. A proximity detector has a detection field adjacent the outlet and a controller connected between the proximity detector and an openable and closable servo valve is activatable for opening the servo valve on detection of an object in the field of the proximity detector. A position-detecting switch associated with the mechanical valve is connected to the controller for activating this controller on shifting of the mechanical valve into its open position and for deactivating the controller on shifting of the mechanical valve into its closed position.

11 Claims, 3 Drawing Sheets

SINGLE-LEVER FAUCET WITH ELECTRONIC CONTROL

FIELD OF THE INVENTION

The present invention relates to a single-lever flow-control valve. More particularly this invention concerns a single-lever faucet with an electronic system for controlling flow and a method of operating such a faucet.

BACKGROUND OF THE INVENTION

A standard single-lever valve, as for instance is typically incorporated in a faucet, has an operating lever that is shifted according to one degree of freedom, normally pivotally up and down, to control the volume of flow through the valve, and according to a second degree of freedom, normally pivotally from side to side, to control the mix of hot and cold water passed through the valve. Thus the user can easily set the volume and temperature.

In U.S. Pat. No. 4,688,277 of Kakinoki a faucet assembly is described which has, in addition to the above-described mechanical control system, a servoactuator that allows the valve to be opened when a proximity detector senses the approach of an object, typically the user's hands under the faucet. Thus this system has a proximity-sensing servo system that can operate the mechanical system. This arrangement is highly effective but very complex and expensive.

OBJECTS OF THE INVENTION

It is therefore an object of the present invention to provide an improved proximity-sensing valve assembly.

Another object is the provision of such an improved proximity-sensing valve assembly which overcomes the above-given disadvantages, that is which controls flow both manually and in accordance with a proximity sensor, but that is much simpler and less expensive to produce than the prior-art systems.

A further object is to provide such a valve whose operation is transparent, that is which appears to function like a traditional single-lever valve, but that has added features.

Yet another object is to provide an improved method of operating a valve equipped with a proximity detector.

SUMMARY OF THE INVENTION

A faucet assembly has according to the invention a conduit defining a flow path between a supply of water and an outlet, a mechanical valve in the conduit and having an open position and a closed position, and a lever coupled to the mechanical valve for shifting it between its open and closed positions. A proximity detector has a detection field adjacent the outlet and a controller connected between the proximity detector and an openable and closable servo valve is activatable for opening the servo valve on detection of an object in the field of the proximity detector. A position-detecting switch associated with the mechanical valve is connected to the controller for activating this controller on shifting of the mechanical valve into its open position and for deactivating the controller on shifting of the mechanical valve into its closed position.

In a standard single-control mixing faucet according to the invention the supply includes a supply of hot water and a supply of cold water and the mechanical valve is operable by movement of the lever in one degree of freedom to control a mix of hot and cold water delivered to the conduit and in another degree of freedom to control the volume of flow from the supply to the conduit. The position-detecting switch is only responsive to movement in the other degree of freedom.

Thus in such a standard faucet with this system the controller and proximity detector are only activated, that is they only function, when the valve has been physically moved out of its closed position by the user manipulating the lever. Thus the user raises the lever to the level for the desired rate of flow and then moves it to one side or another to set the desired hot/cold mix. Flow is initiated as in a standard valve. When, however, the user releases the lever a timer is normally started and if, within a predetermined interval, the proximity detector does not sense an object in its field, the servo valve is shut off to save water. Flow can be reinitiated by touching the lever again.

In accordance with the invention the position-detecting switch is a piezoelectric sensor connected to the lever. It can be mounted in the lever. The proximity detector generates an output signal when an object enters its detection field and the servo valve is a solenoid valve. Typically the mechanical valve is mounted atop a counter and the servo valve and the controller are mounted underneath the counter.

As mentioned above, the controller can also have according to the invention a timer for maintaining the servo valve open for a predetermined interval after exiting of an object from the detection field. Thus the faucet will not shut off immediately, but will wait for a short time, normally no more than five minutes, before shutting itself off, even if the lever is left up.

The faucet assembly in accordance with the invention can also have a contact switch connected to the controller for activating this controller and opening the servo valve on detection of contact with the lever.

The method of this invention therefore includes the steps of first activating the controller and detector and opening the servo valve on detection by the position-detecting switch of movement of the mechanical valve into its open position and/or on detection of contact with the control lever. Thus flow from the valve is initiated just like a standard mechanical valve and in fact the user will not notice any difference. Once, however, the user is no longer touching the control lever and/or holding his or her hands in the field of the proximity detector according to the invention the controller and detector are deactivated to close the servo valve and prevent water from being wasted.

In accordance with the invention closing of the servo valve is delayed for a predetermined short time period after an object is no longer detected by the proximity detector in its field. This presents the water, for example, from shutting off while the user reaches for the soap.

Normally according to the invention the controller the controller maintains the servo valve open for a short time after the control lever is released, to give the user time to place his or her hands under the faucet, whereupon the proximity detector will keep the servo valve open so long as such presence is detected. Once, however, the control lever is released and the user's hands are pulled from the detecting field, the servo valve will automatically closed, even if the user leaves the mechanical valve in the open position.

BRIEF DESCRIPTION OF THE DRAWING

The above and other objects, features, and advantages will become more readily apparent from the following description, reference being made to the accompanying drawing in which:

FIG. 3 is a chart illustrating operation of the system of this invention.

SPECIFIC DESCRIPTION

Figure 1:
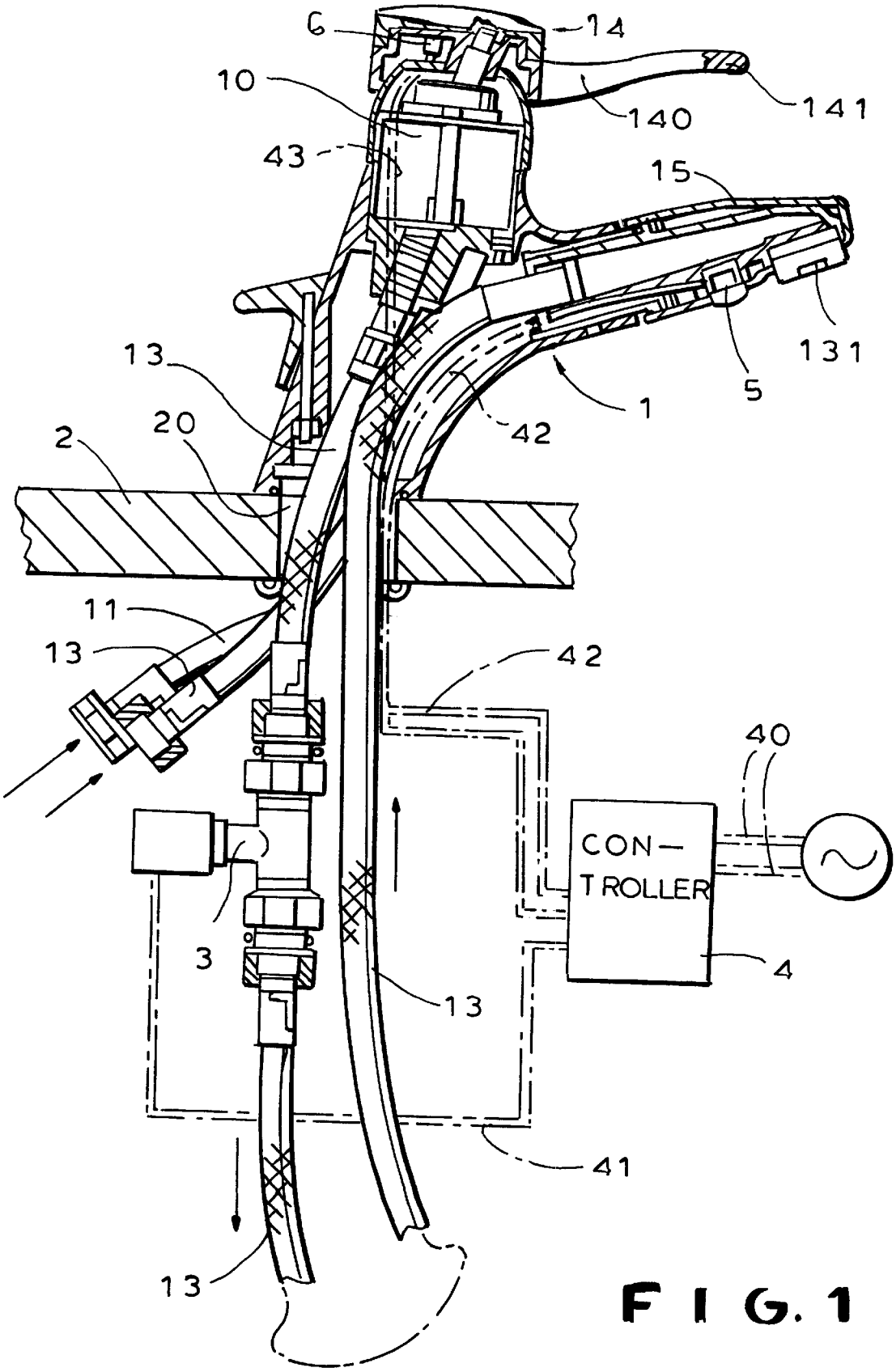
FIG. 1 is a partly schematic and diagrammatic vertical section through a valve assembly according to the invention.
Figure 2:
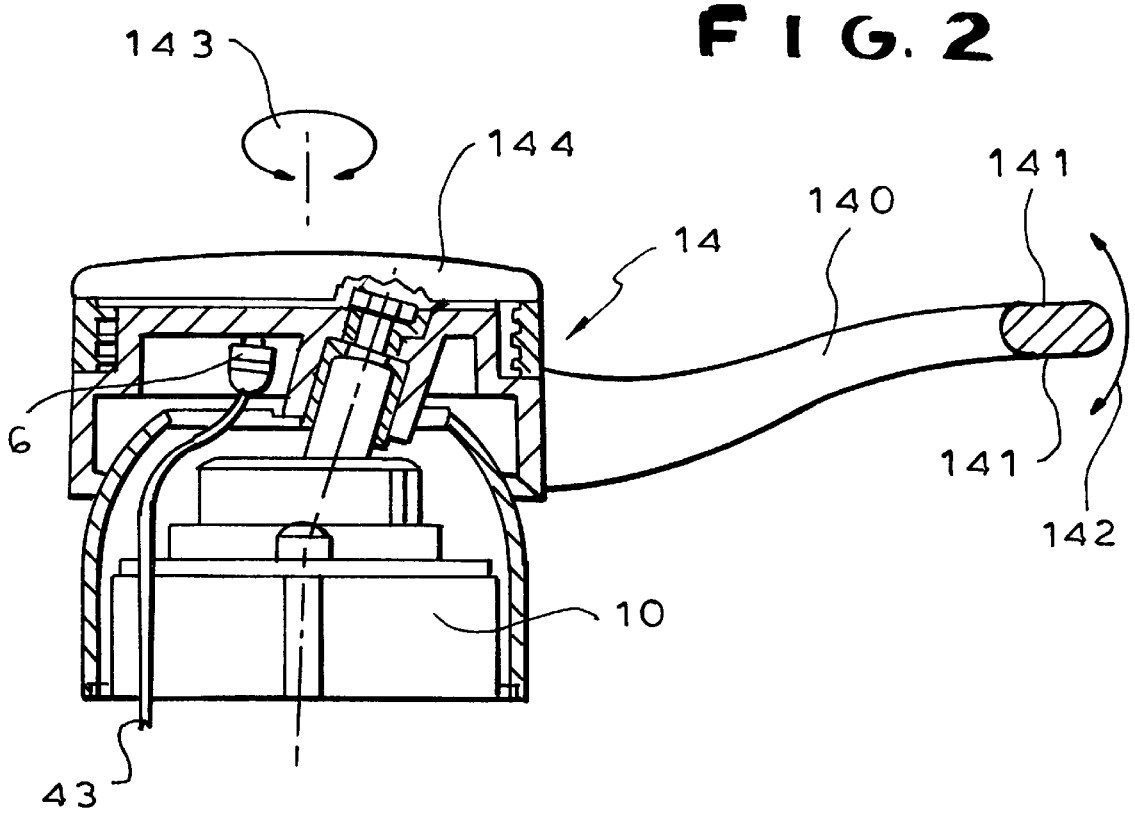
FIGS. 2 and 3 are large-scale views of details of FIG. 1.
Figure 3:
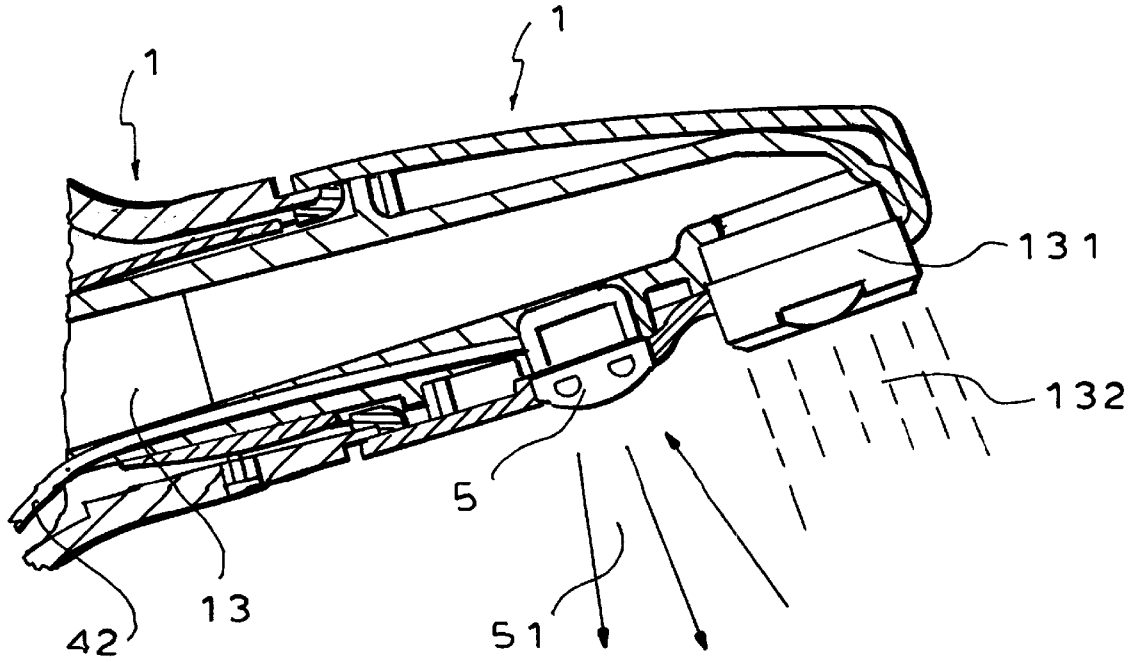

As seen in FIG. 1 a faucet 1 according to the invention is mounted through a single hole 20 in a deck 2 in the conventional manner. This faucet 1 contains a mechanical valve constituted as a standard disk-type valve cartridge 10 connected on its input side to pressurized hot- and cold-water input lines 11 and 12 and on its output side to a conduit or hose 13 that runs back down through the hole 20 and then back up to where it is joined to a pull-out faucet head 15 provided with an aerator 131 as also shown in FIG. 3. An operating lever 14 has a handle 140 with a front end 141 and a cap 144 mounted as shown in FIG. 2 atop the mechanical valve 10. Pivoting the lever 14 up and down about a horizontal axis as indicated by arrow 142 changes the volume rate of flow through the valve 10 and pivoting it from side to side about a vertical axis as shown by arrow 143 changes the mix of hot and cold water delivered to the conduit 13. All this structure is generally standard.

According to the invention a servo or solenoid valve 3 is mounted in the line 13 and can be closed to block flow therethrough. In addition an electronic controller 4 mounted underneath the counter 2 is supplied via wires 40 with line voltage and is connected via a control line 42 to a sensor 5, via a line 43 to a sensor 6, and via a control line 41 to the valve 3. The sensor 5 is a standard infrared or ultrasonic proximity detector and the sensor 6 is a piezoelectric device set up for two functions: detecting contact with the lever 14 and detecting the position of the valve 10 as evidenced by the position of the lever 14.

The basic operation of the system is as follows.

Under normal conditions with the valve 10 in the closed position the controller 40 is deactivated, that is not powered, and the solenoid valve 3 is closed. The sensor 5 is also of course deactivated. Thus both valves 10 and 13 are closed and moving a hand underneath the proximity detector 5 will have no effect.

As soon as the handle 140 is touched, the controller 40 opens the solenoid valve 3 and starts monitoring the sensor 5. If the handle 140 is lifted, water will flow out the aerator 131 in a stream shown at 132 in FIG. 3. As described below, when contact is no longer being made with the handle 140 but the valve is still left in the open position, the controller 4 starts monitoring the proximity detector and maintains the valve 3 open so long as some object is detected in its field 51, and for some short time afterward. The controller 4 maintains the valve 3 open for a short time after the user breaks contact with the lever 140 and only closes this valve 3 if, within that short time, nothing is detected in the field 51.

The side-to-side position of the lever 14 which determines the mix of hot and cold water is unaffected by the various sensors and the controller 4. Thus the outflowing water will be at the set temperature.

When the lever 14 is moved back to the closed position the sensor 6 signals this to the controller 4. The valve 3 is then closed and the sensor 5 is deactivated so that, even if a hand is placed under it, the valve 3 will not be opened.

As a result, the faucet 1 will operate much like a standard faucet except that it will turn itself off after a short time if no contact is made with the handle or lever 140 and nothing is held in the field 51. After being turned on the water flow will continue for a short time after the hand is removed from underneath the sensor 5. The flow can be turned off in the conventional manner, whereupon the controller 4 goes into a standby condition only monitoring the sensor 6. When the flow is not turned off manually, the controller 4 will shut the valve 3 after a brief interval to prevent water from being wasted. Thus if the lever 14 is left in a position corresponding to a predetermined temperature and volume of flow, all the user need do is touch the handle 140 to restore flow of the water. In other words the proximity detector 5 serves only to shut off the water when the faucet is not in use, as determined by failure to detect contact with the handle 140 and any object in the field 51.

Figure 4:
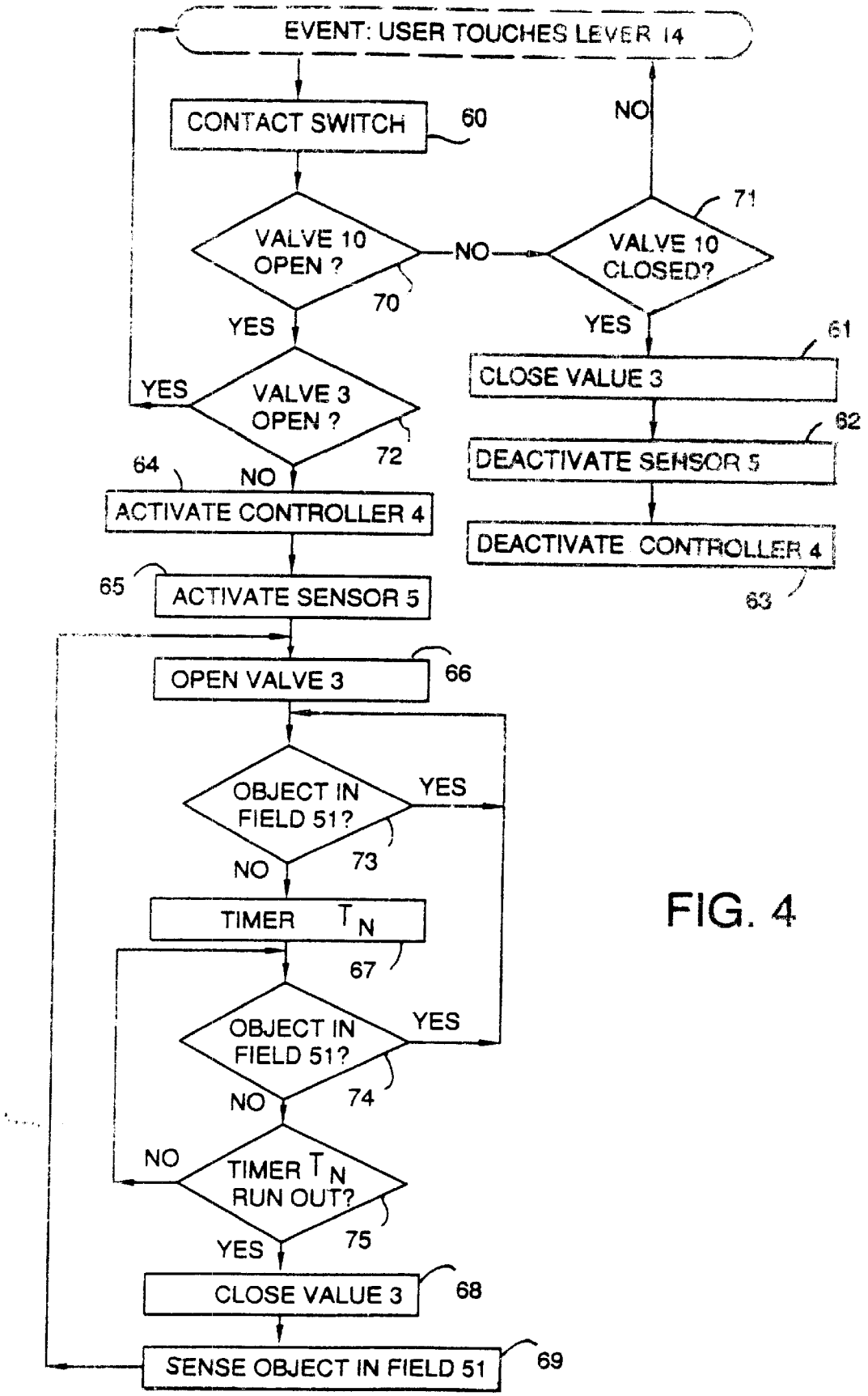

As shown in more detail in FIG. 4, if the user touches the surface of the handle 140, the contact function of the sensor 6 will generate a signal in function block 60. The decision block 70 will determine if the mechanical valve 10 is open or closed. If it is closed, a signal is sent to the decision block 71 to determine if the mechanical valve 10 is closed. If it is not, the controller 4 is reset. If on the contrary it is closed, a signal is sent to the function blocks 61, 62, and 63 so that the magnetic valve 3 is closed and the detector 5 and controller 4 are deactivated.

If on the contrary the decision block 70 returns a yes, a signal is sent to the decision block 72 which determines if the magnetic valve 3 is opened. If so, the controller 4 is reset. If on the contrary it is not, a signal is sent to the function block 64 to activate the controller 4. In addition a signal is sent to the function block 65 and the detector 5 is activated. Finally a signal is emitted to the function block 66 to open the magnetic valve 3 so that the water, whose temperature and volume rate of flow are determined by the position of the lever 14, can flow out the aerator 131. Simultaneously the detector 5 starts operating and determines in the decision block 73 if an object is in its field 51. If so the detector 5 is reset. If not, a signal is sent to the decision block 67 and a timer $T_N$ is started. Then the decision block 74 determines if an object is in the detection field 51. If so the detector 5 is reset. If not, a signal is sent to the decision block 75 and it is determined whether the timer $T_N$ has run out. If not, the detector 5 is set back behind the decision block 67. If so, a signal is sent to the function block 68 and the magnetic valve 3 is closed. On the contrary if an object is detected in the detection field 51 a signal is emitted ahead of the function block 66 and the valve 3 is again opened and the cycle is repeated.

The timer $T_N$ in the function block 67 is formed as a timer with a setting variable from 0 to 5 seconds.

Alternatively the controller 4 can be set up such that during the time when the lever 14 is being touched by the user, the magnetic valve 3 is brought into the open position and is held open during the entire time the user is in contact with the lever 14, with the detector 5 inactive and water allowed to flow unimpeded. The closing of the valve 3 is preferably delayed by a timer. Only once contact of the user with the lever 14 is interrupted and the mechanical valve 10 is in the open position is the water flow controlled by the detector 5. The deactivation of the controller 4 and of the detector 5 only takes place when the mechanical valve is physically moved by the user into the closed position.

While in the above-described embodiments the valve 10 is a mixing valve, it can also be a simple flow-control or dosing valve. The controller 4 and the magnetic valve 3 can be separately mounted underneath the counter 2 or integrated into the housing of the faucet 1. In the latter case batteries can be provided for powering it or a voltage feed can pass through the hole 20 to a supply under the counter 2. All such obvious variants are intended to fall within the scope of the following claims.

We claim:

1. A faucet assembly comprising:

a conduit defining a flow path between a supply of water and an outlet;

a mechanical valve in the conduit and having an open position and a closed position;

a lever coupled to the mechanical valve for shifting it between its open and closed positions;

an openable and closable servo valve in the conduit;

a proximity detector having a detection field adjacent the outlet;

control means connected to the proximity detector and the servo valve and activatable for opening the servo valve on detection of an object in the field of the proximity detector; and means including a position-detecting switch associated with the mechanical valve and connected to the control means for maintaining activation of the control means on shifting of the mechanical valve into its open position and for deactivating the control means on shifting of the mechanical valve into its closed position.

2. The faucet assembly defined in claim 1 wherein the supply includes a supply of hot water and a supply of cold water, the mechanical valve being operable by movement of the lever in one degree of freedom to control a mix of hot and cold water delivered to the conduit and in another degree of freedom to control the volume of flow from the supply to the conduit, the position-detecting switch being only responsive to movement in the other degree of freedom.

3. The faucet assembly defined in claim 2 wherein the position-detecting switch is a piezoelectric sensor connected to the lever.

4. The faucet assembly defined in claim 2 wherein the position-detecting switch is connected to the lever.

5. The faucet assembly defined in claim 1 wherein the proximity detector generates an output signal when an object enters its detection field.

6. The faucet assembly defined in claim 1 wherein the servo valve is a solenoid valve.

7. The faucet assembly defined in claim 1 wherein the mechanical valve is adapted to be mounted atop a counter and the servo valve and the controller are adapted to be mounted underneath the counter.

8. The faucet assembly defined in claim 1 wherein the control means includes timer means for holding the servo valve open for a predetermined interval after exiting of an object from the detection field.

9. The faucet assembly defined in claim 1, further comprising means including a contact switch connected to the control means for activating the control means and opening the servo valve on detection of contact with the lever.

10. A method of operating a valve having a conduit defining a flow path between a supply of water and an outlet;

a mechanical valve in the conduit and having an open position and a closed position;

a lever coupled to the mechanical valve for shifting it between its open and closed positions;

an openable and closable servo valve in the conduit;

a proximity detector having a detection field adjacent the outlet;

a contact sensor associated with the lever;

a position-detecting switch associated with the mechanical valve, and a controller connected to the proximity detector and the servo valve the method comprising the steps of:

activating the controller and opening the servo valve on detection by the contact sensor of contact with the lever;

activating the proximity detector when the contact sensor no longer detects contact with the lever but the position-detecting switch detects that the valve is in the open position;

closing the servo valve when, after a predetermined time delay, the proximity detector does not detect an object in its detection field; and deactivating the controller and detector and thereby closing the servo valve on detection by the position-detecting switch of movement of the mechanical valve into its closed position.

11. The method defined in claim 10 wherein the time delay is up to 5 sec.

* * * * *